US011598118B2

(12) United States Patent
Afshari

(10) Patent No.: US 11,598,118 B2
(45) Date of Patent: Mar. 7, 2023

(54) WOOD-TO-METAL POST CLAMP WITH ADJUSTABLE RAIL BRACKET ANGLE (WTMPCWARBA), SET A, B AND C

(71) Applicant: Adam Ata Afshari, Woodland Hills, CA (US)

(72) Inventor: Adam Ata Afshari, Woodland Hills, CA (US)

( * ) Notice: Subject to any disclaimer, the term of this patent is extended or adjusted under 35 U.S.C. 154(b) by 14 days.

(21) Appl. No.: 17/332,983

(22) Filed: May 27, 2021

(65) Prior Publication Data

US 2022/0381054 A1 Dec. 1, 2022

(51) Int. Cl.
*E04H 17/14* (2006.01)

(52) U.S. Cl.
CPC ..... *E04H 17/1473* (2021.01); *E04H 17/1488* (2021.01)

(58) Field of Classification Search
CPC ..... E04H 17/1447; E04H 17/1448; E04H 17/1473; F16B 2/08
USPC ..... 256/65.01, 67, 68, 65.02, 65.03, 65.04, 256/65.05
See application file for complete search history.

(56) References Cited

U.S. PATENT DOCUMENTS 1,330,808 A * 2/1920 James ..... E04H 17/22 52/150
3,089,681 A * 5/1963 Smithwick ..... E04H 17/10 256/23
3,092,407 A * 6/1963 Blonder ..... F16B 2/08 256/65.05
3,157,388 A * 11/1964 Nelson ..... E04H 17/1413 29/897.3
6,802,496 B1 * 10/2004 Preta ..... E04H 17/1447 16/253
10,107,419 B2 * 10/2018 Anderson ..... F16L 3/14

FOREIGN PATENT DOCUMENTS

KR 101177528 B1 * 8/2012 ..... E04H 17/1413

* cited by examiner

*Primary Examiner* — Michael P Ferguson
*Assistant Examiner* — Zachary A Hall

(57) ABSTRACT

A wood rail-to-metal post bracket assembly comprised of two galvanized carriage bolts and nuts; four pieces punched and press-formed from sheet metal; two pieces formed as pipe clamping mechanisms, and two pieces formed as rail brackets. The pipe clamping mechanisms and the rail brackets connecting the respective wood fence rails to an associated elongated pipe member.

1 Claim, 8 Drawing Sheets

WOOD-TO-METAL POST CLAMP WITH ADJUSTABLE RAIL BRACKET ANGLE (WTMPCWARBA), SET A, B AND C

FIELD OF SEARCH

256/21, 256/65.01-65.07, 67, 65.15; 248/228.1; 403/64, 174, 217-219, 2, 230, 270, 271; 411/1, 8,301; 29/525.05; 219/98; 16/253; 403/398, 399, 392,386, 403/191, 199, 400, 233-234, 232.1; 256/68, 65, 69, DIG. 4, DIG. 5; 248/73, 65, 74.1, 248/74.1, 189/33, 20/92, 248/54, 256/55, 256/47, 256/24, 256/72, 52, 651.05, 403,173

REFERENCES CITED

U.S. Patent Documents

| | | |
|---|---|---|
| 1,341,113 | May 1920 | Dottl et al |
| 1,943,766 | January 1934 | MacDonald |
| 2,835,002 | May 1958 | Majewski |
| 3,227,406 | January 1966 | Shelton |
| 4,007,993 | February 1977 | Schwartz |
| 4,471,947 | September 1984 | Osborne |
| 4,526,348 | July 1985 | Cammack |
| 4,899,991 | February 1990 | Brunkan |
| 3,089,681 | May 1963 | Smithwick |
| 3,471,129 | October 1969 | Mpakarakes |
| 3,903,363 | June 1975 | Bohon |
| 3,960,367 | June 1976 | Rogers |
| 4,078,772 | March 1978 | Carbone |
| 4,262,882 | April 1981 | Simcoe et al |
| 5,285 A | September 1847 | Bingham |
| 69,444 A | October 1867 | Johnson |
| 118,156 A | August 1871 | Rohrer |
| 340,263. A | April 1886 | Weber |
| 566,364 A | August 1896 | Wilson |
| 712,259 A | October 1902 | Carr |
| 859,239 A | July 1907 | McFall |
| 1,136,999 A | April 1915 | Bondy |
| 1,225,431 A | May 1917 | Gelbart |
| 1,330,808 A | February 1920 | James |
| 1,643,887 A | September 1927 | Gougler |
| 1,803,508 A | May 1931 | Rossman |
| 2,346,111 A | April 1944 | MacKenzie |
| 2,427,723 A | September 1947 | Hawkins et al |
| 2,715,513 A | June 1955 | Kools |
| 2,906,551 A | September 1959 | May |
| 3,085,788 A | April 1963 | Hawkins |
| 3,092,407 A | June 1963 | Blonder |
| 3,410,527 A | November 1968 | Urosheuich |
| 3,524,627 A | August 1970 | Boganton et al. |
| 3,614,068 A | October 1971 | Koehl |
| 3,648,982 A | March 1972 | Sabel et al. |
| 3,767,236 A | October 1973 | Horgan, Jr. |
| 2,835,002 | May 1958 | J. V. Majewski |
| 3,227,406 | January 1966 | T. M. Shelton Etal |
| 6,386,519 B1 | May 2002 | William D. Priefert |
| 10,760,298 B2 | October 2020 | Fonda Crandall |
| 2005/0028422A1 | February 2005 | Shouji Nakagawa |
| 2005/0263651A1 | December 2005 | GillesDuponchelle |
| 4,471,947 | September 1984 | Charles W. Osborne |
| 5,297,890A | March 1994 | Alfred D. Commins |
| 7,121,530 B1 | October 2006 | John Preta |

Foreign Patent Documents

| | | |
|---|---|---|
| 283666 | December 1966 | Australia |
| 3.00769 | November 1928 | United Kingdom |
| 414755 | August 1934 | United Kingdom |
| GB 2402681 | December 2004 | John Reginald Newton |
| CN 103047236 A | April 2013 | China |
| WO 2009/030000 Al | March 2009 | KING, Stephen, John |

BACKGROUND OF THE INVENTION

Galvanized metal posts/pipes are used for their durability and strength.

A prior art search produced various patented and commercially available connectors, however none of the existing connectors are capable of meeting all of the following criteria:

1—A design that allows adjusting the Y angel of the rail brackets (with respect to the horizon) easily, independently and properly based on land topology.

2—A design that allows adjusting the X angel of the rail brackets properly based on the boundary path.

3—A design that creates a sturdy and durable wood-to-pipe connection, with better grip, ideal for hillsides.

4—A design that minimizes the overall fence footprint, without the post sticking out on one side of fence.

5—A design that accommodates pickets being installed continuously without a gap near the posts/pipes.

The invention, outlined herein, can achieve all of the above.

BRIEF DESCRIPTION OF THE DRAWINGS

The various embodiments and variations thereof conceptually illustrated in the accompanying Figures and/or described herein are merely exemplary and are not meant to limit the scope of the invention. It is to be appreciated that numerous variations of the invention could be contemplated as would be obvious to one of ordinary skill in the art with the benefit of this disclosure.

DESCRIPTION OF INVENTION

The present invention is Wood-to-Metal Post Clamp with Adjustable Rail Bracket Angle (WTMPCWARBA), and has 3 variations (Set A, B and C) to address different scenarios and needs, and can be used in connecting fence rails at ends (first or last posts), corners, straight as well as non-straight and sloping borders. These sets have been designed principally to connect wooden fence frame members to 2⅜ inch metal posts/pipes, suitable for hillside.

Figure 1:
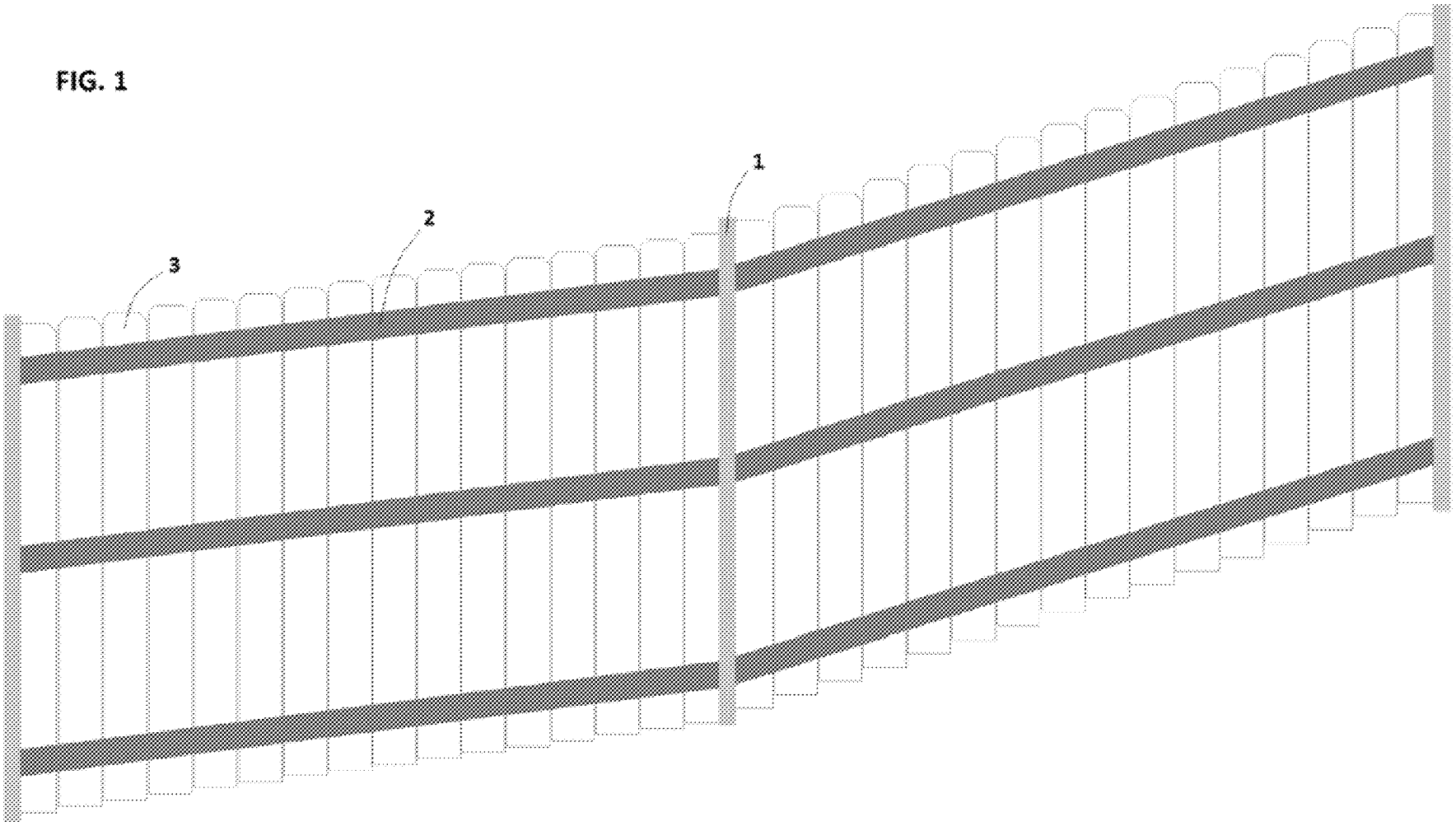
FIG. 1 is a side view of conceptually illustrated wooden fence sections, in order to demonstrate a situation where the rail angles (with respect to horizon) are not the same for every panel on a hillside. For simplicity, some elements such as clamp sets, pipe raincaps, soil or post foundations, are not shown.

FIG. 1 is comprising: installed vertical fence post/pipe 1 in concrete base on hillside (preferably galvanized 2⅜"OD); wooden rail (2×4) 2 connected to posts using clamps and fasteners; pickets 3 (installed continuously on the other side).

Figure 2:
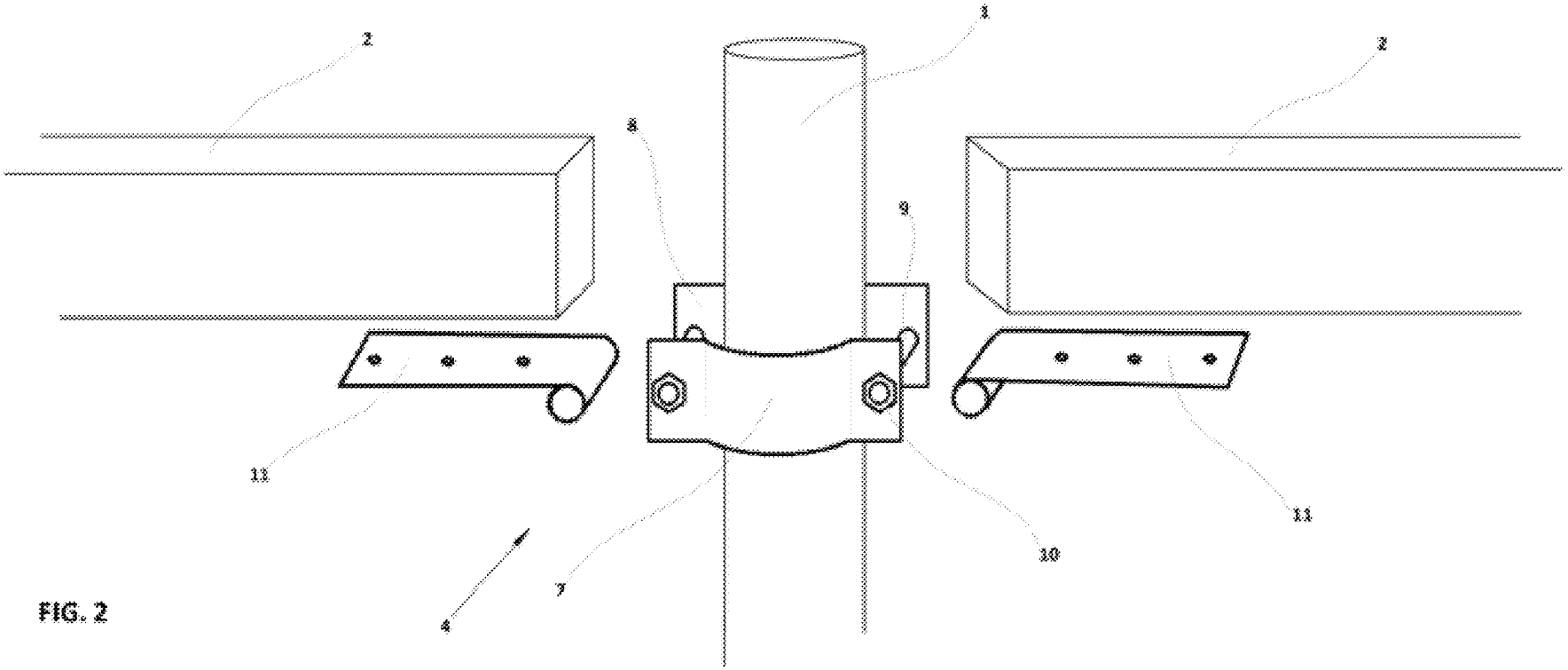
FIG. 2 is a conceptual perspective view of the Set A—For Straight Boundary Lines. It shows the overall configuration of the assembly parts with respect to post/pipe and rails. The pickets should be installed on the flat side, over the carriage bolt head. For simplicity, some elements and details are not shown.

FIG. 2 is comprising: installed vertical fence post/pipe 1 (preferably galvanized 2⅜"OD); wooden rail (2×4) 2; Set A 4; which is comprising: clamp circular piece 7 (preferably galvanized steel minimum gauge 12, punched and formed from sheet metal—the curvilinear portion dimensioned for registering with and partially encircling the fence post/pipe member); clamp flat piece 8 (picket side—preferably galvanized steel minimum gauge 12, punched and formed from sheet metal); carriage bolt 9 (preferably galvanized 5/16 in.-18×2 in.) ; Hex nut 10 (preferably galvanized 5/16 in.-18); two rail brackets 11 (preferably galvanized steel minimum gauge 12, punched and formed from sheet metal).

Figure 3:
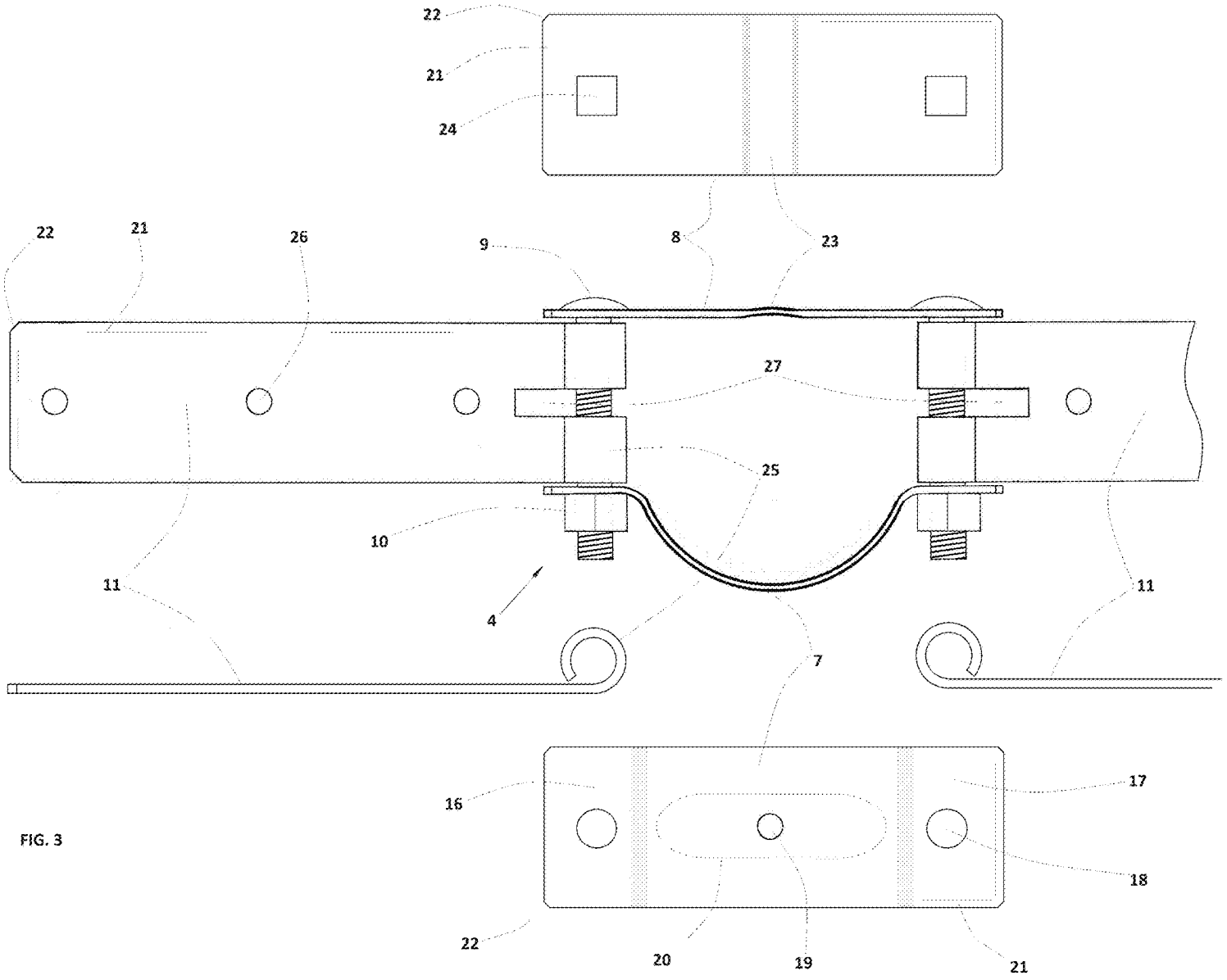
FIG. 3 is a bottom and side plan view of the Set A and its main elements, which were illustrated conceptually in FIG. 2

FIG. 3 is comprising: Set A 4, which is comprising: clamp circular piece 7 (preferably galvanized steel minimum gauge 12, punched and formed from sheet metal—the curvilinear portion dimensioned for registering with and partially encircling the fence post/pipe member), with left side lug 16, with right side lug 17, with round openings 18 dimensioned to receive the threaded carriage bolt, with securing screw hole 19 if required, with slight outward indentations 20 formed in curvilinear portion, with slight outward edge flanges 21 formed on non-curvilinear portion edges adjacent on both sides of left and right lug members 16 and 17 for more stiffening to be obtained, with snipped or rounded outer corners 22; clamp flat piece 8 (on picket side—preferably galvanized steel minimum gauge 12, punched and formed from sheet metal), with slight outward edge flanges 21 formed on non-curvilinear portion edges for more stiffening to be obtained, with snipped or rounded outer corners 22, with curvilinear portion 23 dimensioned for registering with and partially encircling the fence post/pipe member, with square openings 24 dimensioned to receive the carriage bolt neck; carriage bolt 9 (preferably galvanized 5/16 in.-18×2 in.); Hex nut 10 (preferably galvanized 5/16 in.-18); rail bracket 11 (preferably galvanized steel minimum gauge 12, punched and formed from sheet metal), with slight downward edge flanges 21 formed on straight edges for more stiffening to be obtained, with snipped or rounded outer corners 22, with rolled down bolt holder 25 curvilinear portion dimensioned for registering with the threaded bolt, with screw holes 26 for fastening to rails, with compression cutout 27 for the final tightening.

Figure 4:
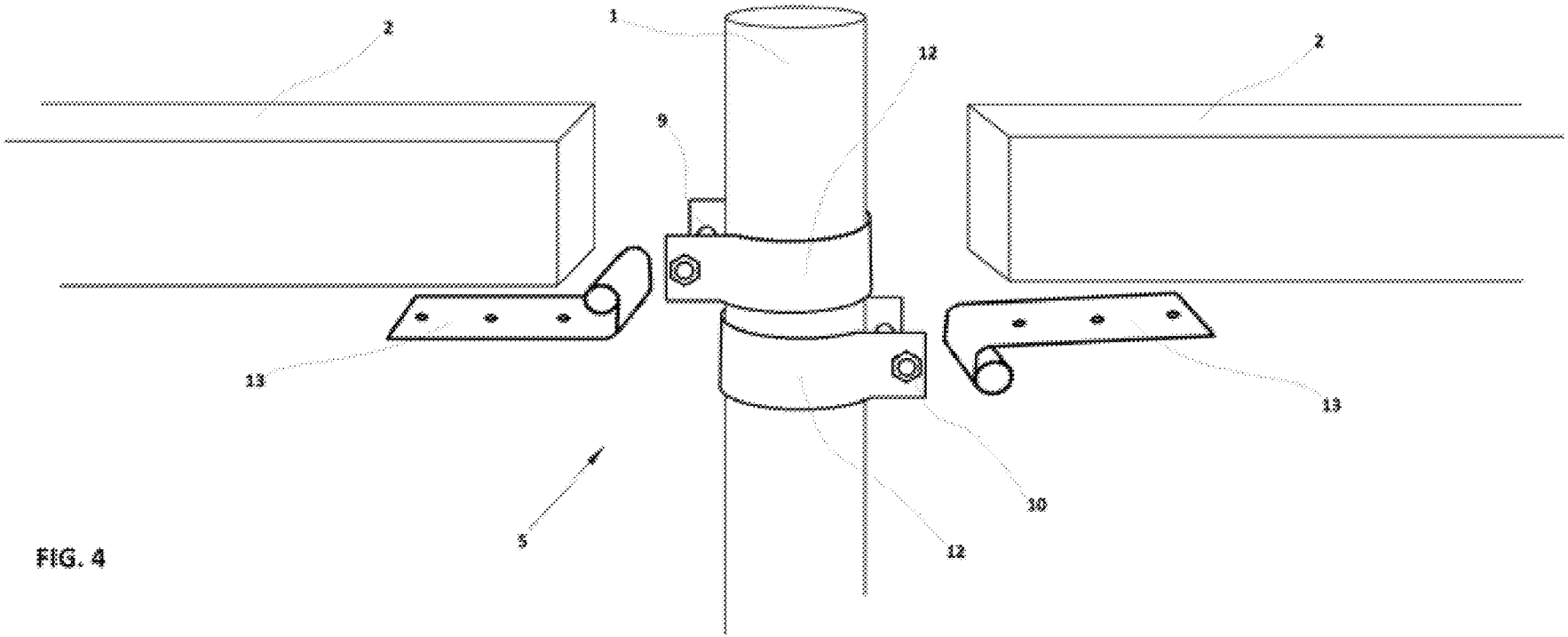
FIG. 4 is a conceptual perspective view of the Set B—for ends (first or last post), corners, straight as well as non-straight and sloping borders. It shows the overall configuration of the assembly parts with respect to post/pipe and rails. The pickets should be installed on the flat side, over the carriage bolt head. For simplicity some elements and details are not shown.

FIG. 4 is comprising: installed vertical fence post/pipe 1 (preferably galvanize 2⅜"OD); wooden rail (2×4) 2; Set B 5, which is comprising: two single clamps 12 (preferably galvanized steel minimum gauge 12, punched and formed from sheet metal—the curvilinear portion dimensioned for registering with and partially encircling the fence post/pipe member); carriage bolts 9 (preferably galvanized 5/16 in.-18×2 in.); Hex nuts 10 (preferably galvanized 5/16 in.-18); step up/down rail bracket 13 (preferably galvanized steel minimum gauge 12, punched and formed from sheet metal).

Figure 5:
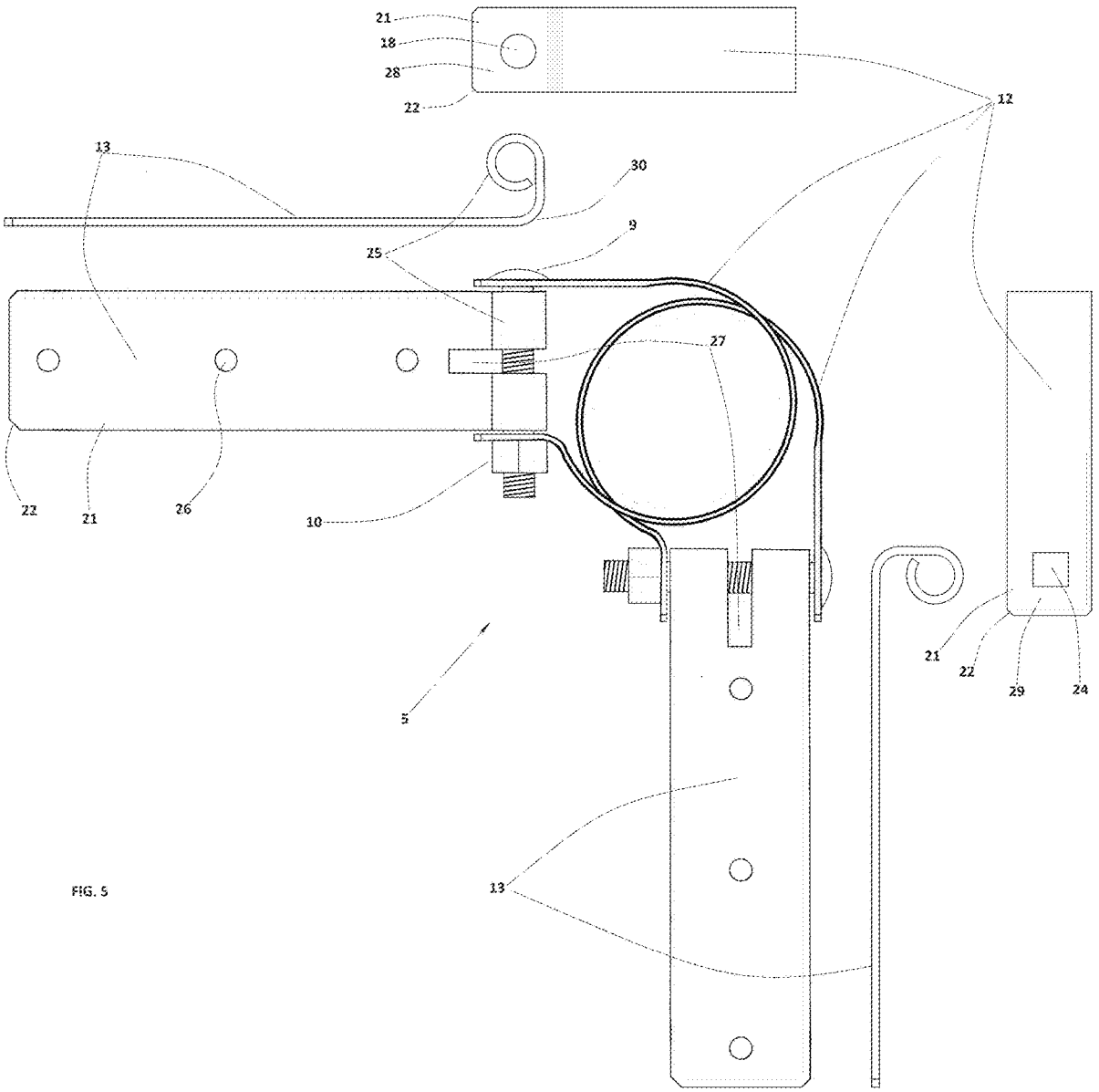
FIG. 5 is a top and side plan view of the Set B and its main elements, which were illustrated conceptually in FIG. 4

FIG. 5 is comprising: Set B 5, which is comprising: two single clamps 12 (preferably galvanized steel minimum gauge 12, punched and formed from sheet metal—the curvilinear portion dimensioned for registering with and partially encircling the fence post/pipe member), with inside lug 28, with outside lug 29, with round openings 18 dimensioned to receive the threaded carriage bolt on inside lug 28, with square openings 24 dimensioned to receive the carriage bolt neck on outside lug 29, with slight outward edge flanges 21 formed on non-curvilinear portion edges adjacent on both sides of inside and outside lug members 28 and 29 for more stiffening to be obtained, with snipped or rounded outer corners 22; carriage bolts 9 (preferably galvanized 5/16 in.-18×2 in.); Hex nuts 10 (preferably galvanized 5/16 in.-18); Step up/down rail bracket 13 (preferably galvanized steel minimum gauge 12, punched and formed from sheet metal), with slight downward edge flanges 21 formed on straight edges for more stiffening to be obtained, with snipped or rounded outer corners 22, with rolled bolt holder 25, curvilinear portion dimensioned for registering with the threaded bolt, with screw holes 26 for fastening to rails, with compression cutout 27 for the final tightening, with step up/down 90-degree bend 30.

Figure 6:
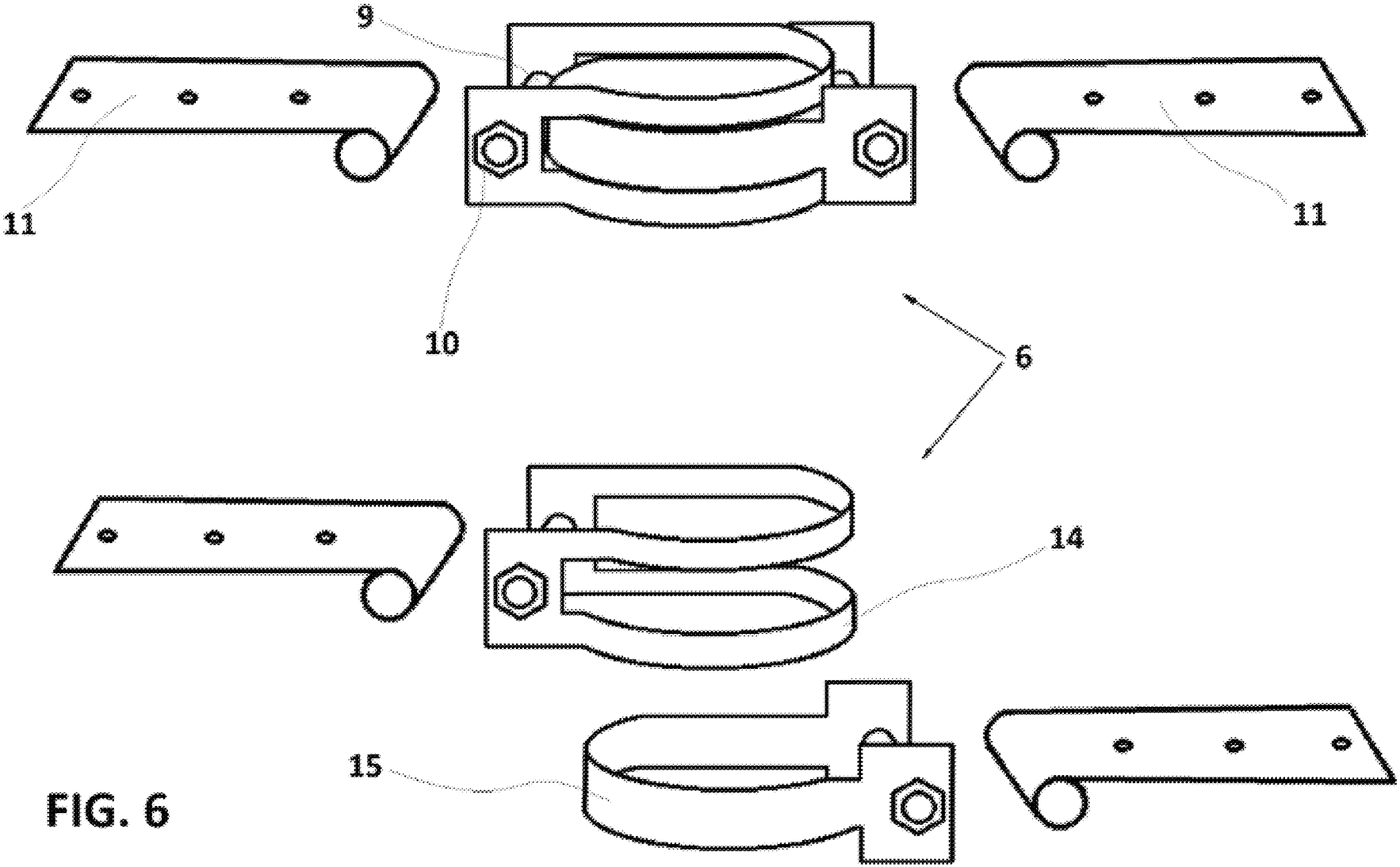
FIG. 6 is a conceptual perspective view of the Set C—for ends (first or last post), corners, straight as well as non-straight and sloping borders. It shows the overall configuration of the assembly parts. For simplicity some details are not shown.

FIG. 6 is comprising: Set C 6, which is comprising: double ring clamp 14; inner ring clamp 15 (the curvilinear portion of the clamps dimensioned for registering with and partially encircling the fence post/pipe member); carriage bolts 9 (preferably galvanized 5/16 in.-18×2 in.); Hex nuts 10 (preferably galvanized 5/16 in.-18); two rail brackets 11 (preferably galvanized steel minimum gauge 12, punched and formed from sheet metal).

Figure 7:
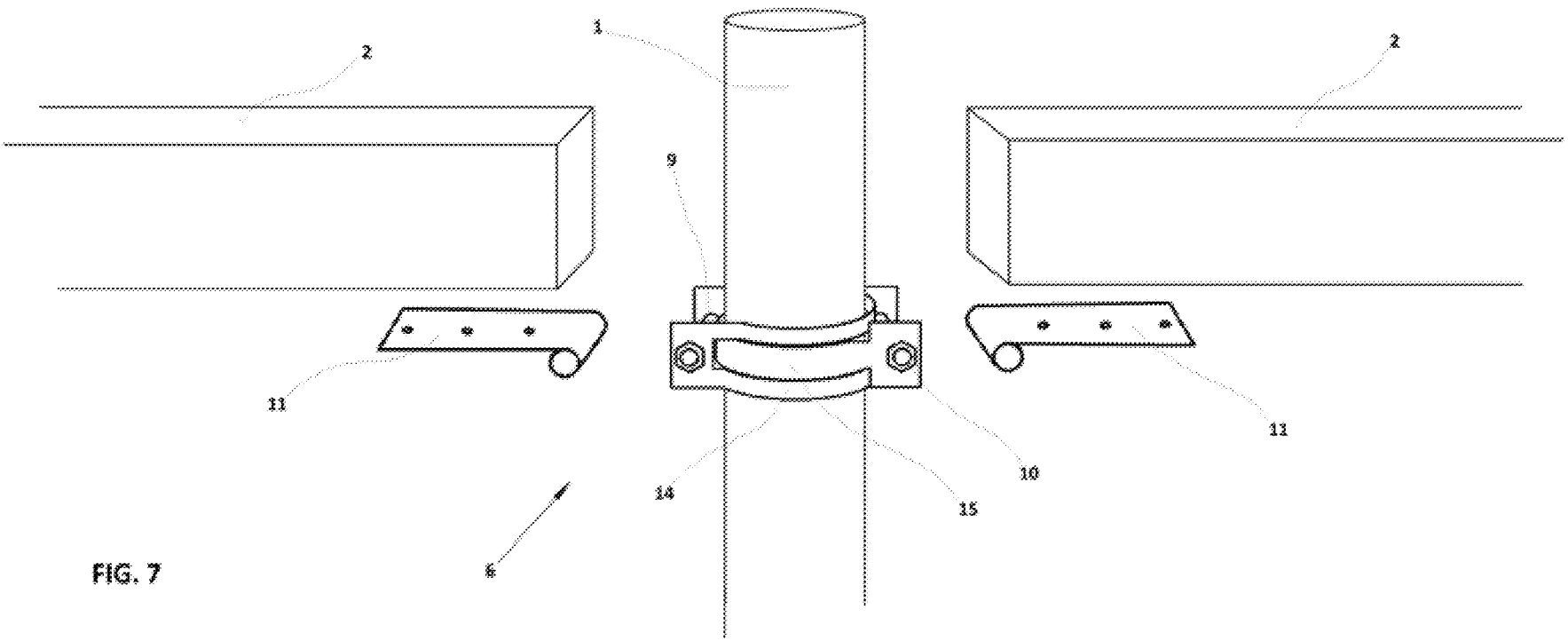
FIG. 7 is a conceptual perspective view of the Set C—for ends (first or last post), corners, straight as well as non-straight and sloping borders. It shows the overall configuration of the assembly parts with respect to post/pipe and rails. The pickets should be installed on the flat side, over the carriage bolts heads. For simplicity some elements and details are not shown.

FIG. 7 is comprising: Installed vertical fence post/pipe 1 (preferably galvanized 2⅜"OD); wooden rail (2×4) 2; Set C 6, which is comprising: double ring clamp 14, inner ring clamp 15 (the curvilinear portion of the clamps dimensioned for registering with and partially encircling the fence post/pipe member); carriage bolts 9 (preferably galvanized 5/16 in.-18×2 in.); Hex nuts 10 (preferably galvanized 5/16 in.-18); two rail brackets 11 (preferably galvanized steel minimum gauge 12, punched and formed from sheet metal).

Figure 8:
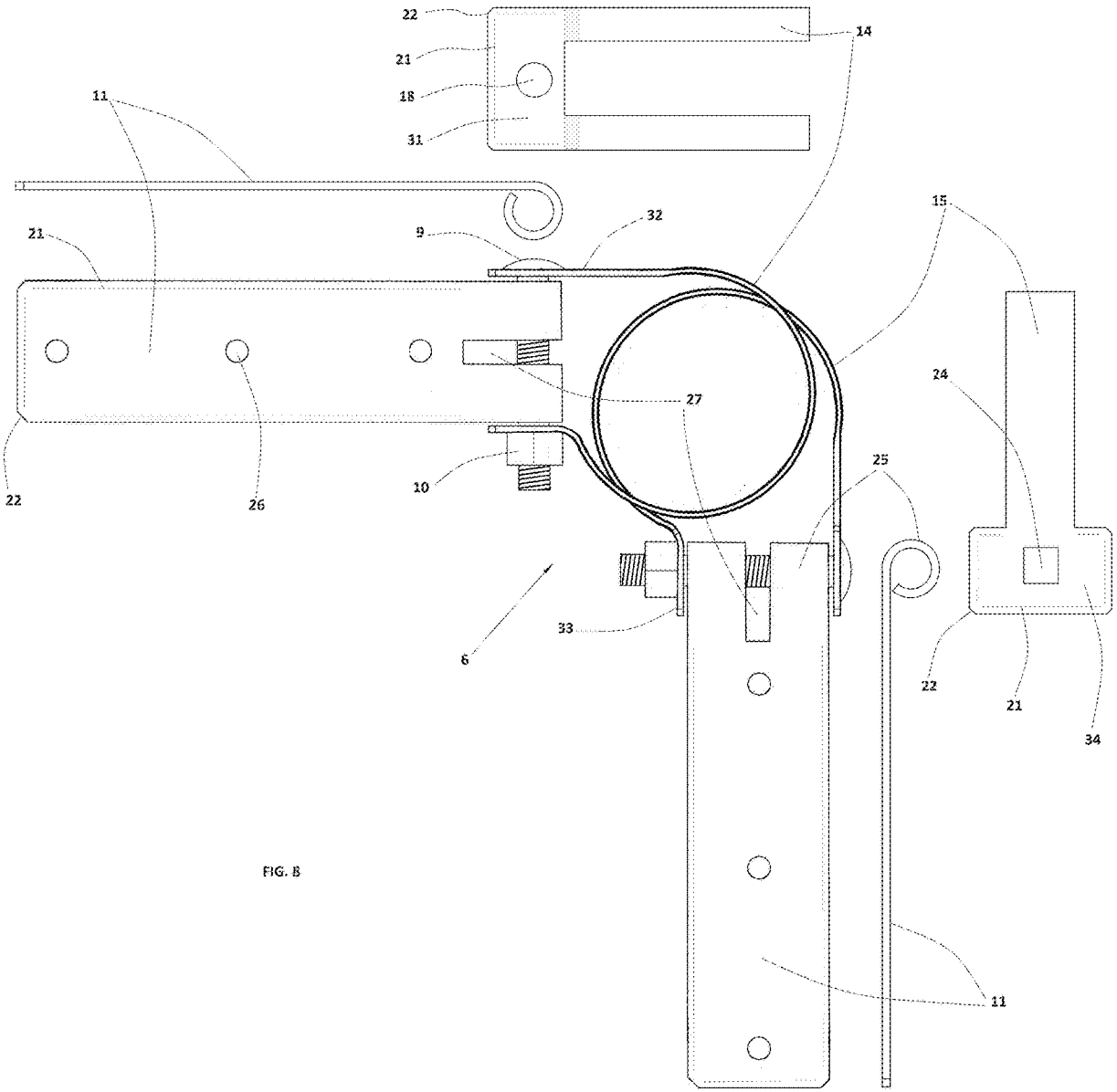
FIG. 8 is a top and side plan view of the Set C and its main elements, which were illustrated conceptually in FIGS. 6 & 7.

FIG. 8 is comprising: Set C 6, which is comprising: double ring clamp 14 (preferably galvanized steel minimum gauge 12, punched and formed from sheet metal—the curvilinear portion dimensioned for registering with and partially encircling the fence post/pipe member—the gap between rings dimensioned to receive the inner ring clamp 15 without difficulty), with inside lug 31, with outside lug 32, with round openings 18 dimensioned to receive the threaded carriage bolt on inside lug 31, with square openings 24 dimensioned to receive the carriage bolt neck on outside lug 32, with slight outward edge flanges 21 formed on non-curvilinear portion edges adjacent on both sides of inside and outside lug members 31 and 32 for more stiffening to be obtained, with snipped or rounded outer corners 22; inner ring clamp 15 (preferably galvanized steel minimum gauge 12, punched and formed from sheet metal—the curvilinear portion dimensioned for registering with and partially encircling the fence post/pipe member—the narrow portion dimensioned to be fitted into double ring clamp 14 cutout without difficulty), with inside lug 33, with outside lug 34, with round openings 18 dimensioned to receive the threaded carriage bolt on inside lug 33, with square openings 24 dimensioned to receive the carriage bolt neck on outside lug 34, with slight outward edge flanges 21 formed on non-curvilinear portion edges adjacent on both sides of inside and outside lug members 33 and 34 for more stiffening to be obtained, with snipped or rounded outer corners 22; carriage bolt 9 (preferably galvanized 5/16 in.-18×2 in.); Hex nut 10 (preferably galvanized 5/16 in.-18); rail bracket 11 (preferably galvanized steel minimum gauge 12, punched and formed from sheet metal), with slight downward edge flanges 21 formed on straight edges for more stiffening to be obtained, with snipped or rounded outer corners 22, with rolled down bolt holder 25 (curvilinear portion dimensioned for registering with the threaded bolt), with screw holes 26 for fastening to rails, with compression cutout 27 for the final tightening.

What is claimed is:

1. A wood rail-to-metal fence post bracket assembly, comprising:

an upper post clamp and a lower post clamp, each post clamp comprising:

an annular body portion for encircling and receiving a vertical metal fence post therethrough, the annular body portion having opposing ends each with a lug radially extending outwardly therefrom;

one of the lugs comprising a round opening for receiving a shaft of a threaded carriage bolt therethrough, and the other of the lugs comprising a square opening for receiving a neck of the carriage bolt therethrough;

wherein the upper and lower post clamps are vertically aligned to receive the fence post therethrough with the upper post clamp being coupled to a first fence rail and the lower post clamp being coupled to a second fence rail;

a first stepped rail bracket and a second rail stepped rail bracket, each rail bracket formed from an elongated rectangular piece of sheet metal and comprising:

a planar first portion having a plurality of screw holes therethrough for affixing a wood fence rail thereto;

a planar second portion bent perpendicular to the first portion and creating a stepped bend, the second planar portion comprising a pair of finger-shaped projections extending from the first portion with a compression cutout located therebetween; and an inwardly-bent rolled cylindrical portion formed at an end of each finger-shaped projection of the second planar portion, the cylindrical portions defining an aperture for receiving a carriage bolt therethrough;

wherein the cylindrical portions of the first rail bracket are received between the lugs of the upper post clamp such that the aperture of the cylindrical portions is aligned with the openings of the lugs to receive a respective carriage bolt therethrough to pivotally couple the first rail bracket to the upper post clamp, and wherein the carriage bolt is tightened such to clamp the lugs against the finger-shaped projections and compress the compression cutout;

wherein the cylindrical portions of the second rail bracket are received between the lugs of the lower post clamp such that the aperture of the cylindrical portions is aligned with the openings of the lugs to receive a respective carriage bolt therethrough to pivotally couple the second rail bracket to the lower post clamp, and wherein the carriage bolt is tightened such to clamp the lugs against the finger-shaped projections and compress the compression cutout; and wherein the first portion of the first rail bracket is stepped vertically below the cylindrical portions of the first rail bracket, and wherein the first portion of the second rail bracket is stepped vertically above the cylindrical portions of the second rail bracket such that the first portions of the first and second rail brackets are configured to be longitudinally aligned to longitudinally align first and second fence rails affixed thereto.

* * * * *